United States Patent [19]

Sashihara et al.

[11] 4,030,930

[45] June 21, 1977

[54] HEAT-DEVELOPABLE LIGHT-SENSITIVE MATERIAL

[75] Inventors: Kenji Sashihara; Takao Masuda; Yasuhiro Noguchi; Nobuyoshi Sekikawa, all of Asaka; Tadao Shishido, Minami-ashigara, all of Japan

[73] Assignee: Fuji Photo Film Co., Ltd., Minami-ashigara, Japan

[22] Filed: Feb. 18, 1975

[21] Appl. No.: 550,503

[30] Foreign Application Priority Data

Feb. 15, 1974 Japan ..... 49-18378

[52] U.S. Cl. ..... 96/114.1; 96/48 HD; 96/58; 96/66 T; 96/114.6

[51] Int. Cl.[2] ..... G03C 1/02; G03C 1/76

[58] Field of Search ..... 96/114.1, 114.6, 56, 96/66, 58, 66 T, 48 HD; 252/62.1 P, 62.1 L

[56] References Cited

UNITED STATES PATENTS

| | | | |
|---|---|---|---|
| 3,152,904 | 10/1964 | Sorensen et al. | 96/114.1 X |
| 3,457,075 | 7/1969 | Morgan et al. | 96/114.1 X |
| 3,671,242 | 6/1972 | Liebe et al. | 96/58 X |
| 3,672,891 | 6/1972 | Wyand et al. | 96/66 HD |
| 3,846,136 | 11/1974 | Sullivan | 96/114.1 |
| 3,881,938 | 5/1975 | Masuda et al. | 96/58 X |

OTHER PUBLICATIONS

Henn et al., Photographic Developing Agents, pp. 135–139, Photographic Science & Eng., vol. 3, No. 3, May–June 1959.

*Primary Examiner*—Thomas J. Herbert, Jr.
*Attorney, Agent, or Firm*—Sughrue, Rothwell, Mion, Zinn & Macpeak

[57] ABSTRACT

A heat-developable light-sensitive material comprising a support having thereon at least one layer containing (a) an organic silver salt oxidizing agent; (b) a catalytic amount of a light-sensitive silver halide or a compound capable of forming a light-sensitive silver halide through reaction with the organic silver salt component (a); (c) a reducing agent; and (d) at least one compound represented by the following general formulae (I) to (III)

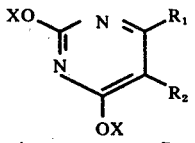
(I)

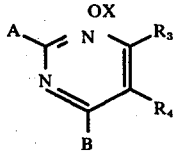
(II)

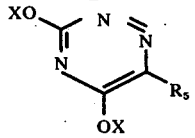
(III)

in which A and B each represents different substituents selected from the group consisting of an amino group and a —OX group; X represents a hydrogen atom, an alkali metal atom, a silver atom, a mercury atom or a gold atom; $R_1$ and $R_2$ each represents a hydrogen atom, a halogen atom, an alkyl group, an alkoxy group, an aralkyl group, an allyl group, an acyl group, an aryl group or an aryloxy group; and $R_3$, $R_4$ and $R_5$ each represents a hydrogen atom, a halogen atom or an alkyl group.

9 Claims, No Drawings

HEAT-DEVELOPABLE LIGHT-SENSITIVE MATERIAL

BACKGROUND OF THE INVENTION

1. Field of the Invention

This invention relates to a heat-developable light-sensitive material, particularly, a heat-developable light-sensitive material capable of providing an image having a black color tone.

2. Description of the Prior Art

The photographic process using a silver halide is the most commonly used photographic process, since this process is superior to the electrophotographic process or the diazo-photographic process in photographic properties such as sensitivity and gradation. However, the silver halide light-sensitive material used in this process is imagewise exposed, developed with a developer and, furthermore, subjected to several processings such as stopping, fixing, water washing and stabilizing to prevent the developed image from discoloring or fading and the non-developed area (which will hereinafter be referred to as "background") from blackening. Thus the photographic process using a silver halide has a disadvantage that much time and labor are required for the processing, the handling of the chemicals is harmful to the human body and the processing rooms and the hands and workers' clothes are stained. Therefore, it has been very desirable to improve the photographic process using a silver halide so that the processing can be carried out under dry conditions without using solutions and so that a stable processed image can be obtained. Many efforts have been made to this end.

One proposal is to use a light-sensitive element consisting of a silver salt of a long chain aliphatic carboxylic acid such as silver behenate, silver saccharin or silver benzotriazole, as a main component, and a catalytic amount of a silver halide, as disclosed in U.S. Pat. Nos. 3,152,904, 3,457,075 and 3,635,719 and British Pat. Nos. 1,163,187 and 1,205,500.

The present invention is concerned with a heat-developable light-sensitive material of this kind. In the heat-developable light-sensitive materials which have hitherto been proposed, for example, compositions comprising a silver salt of a fatty acid, a reducing agent and a catalytic amount of a silver halide, an image obtained after imagewise exposure and heat development has a light brown color tone. Therefore, the contrast between the image area and the non-image area is too low. In order to increase the contrast, it is thus desirable to increase the color density of the image and to provide a black color tone to the image.

U.S. Pat. Nos. 3,080,254 and 3,107,174 disclose that phthalazinone is effective for increasing the color density of an image, as a color toning agent. However, phthalazinone has the disadvantage that the developing apparatus is often damaged by sublimed phthalazinone and the cost of producing the light-sensitive material increases because phthalazinone is expensive. Various efforts to seek excellent color toning agents in place of phthalazinone have been made and, for example, some compounds are disclosed in U.S. Pat. No. 3,846,136.

SUMMARY OF THE INVENTION

It has now been found as a result of research that pyrimidine derivatives have a particularly excellent color toning action as a compound substantially free from sublimation problems.

A principal object of the invention is to provide a heat-developable light-sensitive material containing a color toning agent which is capable of making the color tone of the developed image black and which is substantially non-sublimable.

That is to say, the present invention provides a heat-developable light-sensitive material comprising a support having thereon at least one layer containing (a) an organic silver salt oxidizing agent, (b) a catalytic amount of a light-sensitive silver halide or a compound capable of forming a light-sensitive silver halide through reaction with the organic silver salt component (a), (c) a reducing agent, and (d) at least one compound represented by the following general formulas (I) to (III)

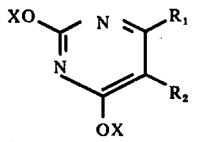
(I)

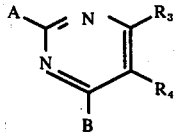
(II)

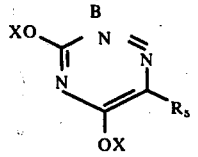
(III)

in which A and B each represents a different substituent selected from the group consisting of an amino group and an —OX group; X represents a hydrogen atom, an alkali metal atom, a silver atom, a mercury atom or a gold atom; $R_1$ and $R_2$ each represents a hydrogen atom, a halogen atom, or an alkyl group (both an unsubstituted and a substituted alkyl group), an alkoxy group, an aralkyl group, an allyl group, an acyl group, an aryl group or an aryloxy group, each having up to 21 carbon atoms, preferably up to 4 carbon atoms; and $R_3$, $R_4$ and $R_5$ each represents a hydrogen atom, a halogen atom or an alkyl group (both an unsubstituted and a substituted alkyl group each having 1 to 21 carbon atoms, preferably 1 to 4 carbon atoms).

In the above described general formulas (I) to (III), preferred examples of the alkali metal atoms for X are lithium, sodium, potassium and rubidium atoms, preferred examples of the halogen atoms for $R_1$, $R_2$, $R_3$, $R_4$ and $R_5$ are chlorine, bromine and iodine atoms, preferred examples of alkyl groups are those having 1 to 4 carbon atoms such as methyl, ethyl, propyl, butyl and t-butyl groups and preferred examples of alkoxy groups are those having 1 to 4 carbon atoms such as methoxy, ethoxy, propoxy and butoxy groups. Preferred acyl groups are those having 1 to 4 carbon atoms such as a formyl group, an acetyl group, a propionyl group, and a butyryl group. Preferred aryl groups are phenyl and 1-naphthyl groups and preferred substituted alkyl groups are haloalkyl groups having 1 to 4 carbon atoms in the alkyl moiety such as chloromethyl and β-bromoethyl groups, hydroxyalkyl groups having 1 to 4 carbon atoms in the alkyl moiety such as hydroxymethyl and β-hydroxyethyl groups, aminoalkyl groups having 1 to 4 carbon atoms in the alkyl moiety such as aminoethyl and aminobutyl groups, monoalkyl- or dialkyl-aminoalkyl groups having 1 to 4 carbon atoms in the alkyl moiety and 1 to 4 carbon atoms in the alkyl moiety or moieties of the monoalkyl- or dialkyl-amino substituent, such as dimethylaminoethyl and dimethylaminomethyl groups. Preferred aralkyl groups are benzyl and phenethyl groups.

Typical examples of compounds represented by the general formulas (I) to (III) used as the color toning agent component (d) in the invention are as follows:

Table 1

(Examples of Compounds Represented by General Formula (I))

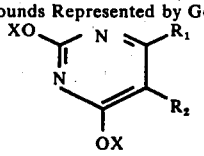

| Compound No. | X | $R_1$ | $R_2$ |
|---|---|---|---|
| 1 | H | H | H |
| 2 | Ag | H | H |
| 3 | Hg | H | H |
| 4 | K | K | K |
| 5 | Na | H | H |
| 6 | Li | H | H |
| 7 | Au | H | H |
| 8 | H | $CH_3$ | H |
| 9 | H | $CH_3$ | $CH_3$ |
| 10 | H | H | $CH_3$ |
| 11 | H | $C_2H_5$ | H |
| 12 | H | $CH_3$ | $C_2H_5$ |
| 13 | H | $C_3H_7$ | H |
| 14 | H | $CH_3$ / $CH_3$ >CH— | H |
| 15 | H | $(CH_3)_3C$— | H |
| 16 | H | $CH_3$ / $CH_3$ >CH— | $CH_3$ / $CH_3$ >CH— |
| 17 | H | H | I |
| 18 | H | H | Br |
| 19 | H | H | Cl |
| 20 | H | H | F |
| 21 | H | H | $NO_2$ |
| 22 | H | $CH_3$ | $CH_2$=CH—$CH_2$— |
| 23 | H | 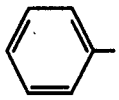 | H |
| 24 | H | 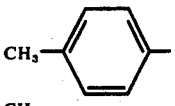 | H |
| 25 | H | $CH_3$ | 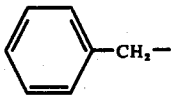 |
| 26 | H | $CH_3$ | $CH_3CO$— |
| 27 | H | H | 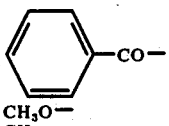 |
| 28 | H | H | $CH_3O$— |
| 29 | H | $CH_3$ / $CH_3$ >CHO— | $CH_3$ / $CH_3$ >CH— |
| 30 | H | H | 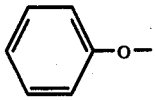 |
| 31 | H | H | —$CH_2OH$ |
| 32 | H | $CH_3$ | —$C_2H_4OH$ |
| 33 | H | —$CH_2OH$ | H |

Table 2

(Examples of Compounds Represented by General Formula (II) where A is an Amino Group and B is an —OX Group)

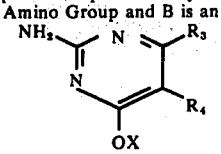

| Compound No. | X | $R_3$ | $R_4$ |
|---|---|---|---|
| 34 | H | H | H |
| 35 | Ag | H | H |
| 36 | Hg | H | H |
| 37 | K | H | H |
| 38 | Na | H | H |
| 39 | Li | H | H |
| 40 | Au | H | H |
| 41 | H | H | $CH_3$ |
| 42 | H | $CH_3$ | H |
| 43 | H | $CH_3$ | $CH_3$ |
| 44 | H | $C_2H_5$ | H |
| 45 | H | $CH_3$ | $C_5H_{11}$ |
| 46 | H | H | Br |
| 47 | H | $CH_3$ | Br |
| 48 | H | Cl | H |

Table 3

(Examples of Compounds Represented by General Formula (II) where A is an —OX Group and B is an Amino Group)

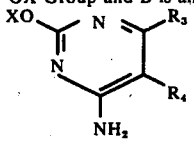

| Compound No. | X | $R_3$ | $R_4$ |
|---|---|---|---|
| 49 | H | H | H |
| 50 | Ag | H | H |
| 51 | Hg | H | H |
| 52 | K | H | H |
| 53 | Na | H | H |
| 54 | Li | H | H |
| 55 | Au | H | H |
| 56 | H | H | $CH_3$ |
| 57 | H | $CH_3$ | H |
| 58 | H | $CH_3$ | $CH_3$ |
| 59 | H | $C_2H_5$ | H |
| 60 | H | $CH_3$ | $C_5H_{11}$ |
| 61 | H | H | Br |
| 62 | H | $CH_3$ | Br |
| 63 | H | Cl | H |

Table 4

(Examples of Compounds Represented by General Formula (III))

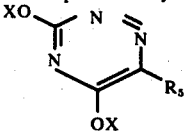

| Compound No. | X | $R_5$ |
|---|---|---|
| 64 | H | H |
| 65 | K | H |
| 66 | Ag | H |
| 67 | H | $CH_3$ |

These compounds can be synthesized using the methods, for example, described in *J. Am. Chem. Soc.*, 58, 1150 (1936); *Helv. Chim. Acta.*, 17, 665 (1934); *J. Chem. Soc.*, 1956, 4106; *J. Am. Chem. Soc.*, 35, 1007 (1913); *Am. Chem. J.*, 29, 480 (1903); and "The Pyrimidines," in *The Chemistry of Heterocyclic Compounds*, A. Weissberger, Ed., Vol. 16, Interscience Publishers, 1962.

The quantity of component (d) used in the heat-developable light-sensitive material of the invention is about $1 \times 10^{-3}$ mol to 5 mols, preferably $5 \times 10^{-3}$ mol to 1 mol, per mol of the silver salt oxidizing agent component (a). As the silver salt oxidizing agent component (a) used in the invention, silver salts of aliphatic carboxylic acids, aromatic carboxylic acids and organic compounds containing an imino group or a mercapto group. These silver salts, being relatively stable to light, are oxidizing agents which after exposure are capable of forming silver images in the exposed area through an oxidation-reduction reaction with the reducing agent, component (c), when heated, due to the catalytic action of the silver halide component (b). Examples of suitable silver salt oxidizing agents are as follows:

1. Silver salts of aliphatic carboxylic acids

Silver caprate, silver laurate, silver myristate, silver palmitate, silver stearate, silver behenate, silver maleate, silver fumarate, silver sebacate, silver tartrate, silver adipate, silver linoleate, etc.

2. Silver salts of aromatic carboxylic acids

Silver benzoate, silver 3,5-dihydroxybenzoate, silver 6-methylbenzoate, silver m-methylbenzoate, silver p-methylbenzoate, silver 2,4-dichlorobenzoate, silver gallate, silver tannate, silver phthalate, silver terephthalate, silver salicylate, etc.

3. Silver salts of organic compounds containing an imino group

Silver saccharin, silver benzotriazole, silver phthalazinone silver salt of 4-hydroxy-6-methyl-1,3,3a,7-tetrazaindene, etc.

4. Silver salts of organic compounds containing a mercapto group

Silver salt of 3-mercapto-4-phenyl-1,2,4-triazole

As component (c), the reducing agent used in the invention organic reducing agents having a sufficient reducing capability to reduce the silver salt oxidizing agent component (a) and form a silver image, when heated, due to the catalytic action of the silver halide compound (b) in the exposed area are used. These reducing agents are selected depending on the combination with the particular silver salt oxidizing agent component (a), and generally include the following types of compounds 1. Monohydroxybenzenes
2. Dihydroxybiphenyls
3. Di- and Polyhydroxybenzenes
4. Naphthols, Naphthylamines and Aminonaphthols
5. Hydroxybinaphthyls
6. Aminophenols
7. p-Phenylenediamines
8. Alkylenebisphenols
9. Ascorbic acid and its derivatives
10. Pyrazolidones Specific examples of these reducing agents are as follows:

1. MONOHYDROXYBENZENES p-Phenylphenol, o-phenylphenol, p-ethylphenol, p-t-butylphenol, p-sec-butylphenol, p-t-amylphenol, p-methoxyphenol, p-ethoxyphenol, p-cresol, 2,6-di-t-butyl-p-cresol, 2,4-xylenol, 2,6-xylenol, 3,4-xylenol, p-acetylphenol, 1,4-dimethoxyphenol, 2,6-dimethoxyphenol, hydroquinone mono-n-hexyl ether, hydroquinone monobenzyl ether, chlorophenol, thymol, etc.

2. DIHYDROXYBIPHENYLS 3,3',5,5'-Tetra-t-butyl-4,4'-dihydroxybenzene, etc.

3. DI- AND POLYHYDROXYBENZENES

Hydroquinone, methylhydroquinone, t-butylhydroquinone, 2,5-dimethylhydroquinone, 2,6-dimethylhydroquinone, t-octylhydroquinone, phenylhydroquinone, methoxyhydroquinone, ethoxyhydroquinone, chlorohydroquinone, bromohydroquinone, hydroquinonemonosulfonate, catechol, 3-cyclohyxylcatechol, resorcinol, gallic acid, methyl gallate, n-propyl gallate, etc.

4. NAPHTHOLS, NAPHTHYLAMINES AND AMINONAPHTHOLS

α-Naphthol, β-naphthol, 1-hydroxy-4-methoxynaphthalene, 1-hydroxy-4-ethoxynaphthalene, 1,4-dihydroxynaphthalene, 1,5-dihydroxynaphthalene, 1-hydroxy-2'-phenyl-4-methoxynaphthalene, 1-hydroxy-2-methyl-4-methoxynaphthalene, potassium 1-amino-2-naphthol-6-sulfonate, 1-hydroxy-4-aminonaphthalene, 1-naphthyl-amine-7-sulfonic acid, etc.

5. HYDROXYBINAPHTHYLS 1,1'-Dihydroxy-2,2'-binaphthyl, 4,4'-dimethoxy-1,1'-dihydroxy-2,2'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, etc.

6. AMINOPHENOLS p-Aminophenol, o-aminophenol, 2,4-diaminophenol, N-methyl-p-aminophenol, 2-methoxy-4-aminophenol, 2-β-hydroxyethyl-4-aminophenol, etc.

7. p-PHENYLENEDIAMINES

N,N'-Diethyl-p-phenylenediamine, N,N'-dibenzylidene-p-phenylenediamine, etc.

8. ALKYLENEBISPHENOLS 1,1-bis-(2-Hydroxy-3-t-butyl-5-methylphenyl)methane, 1,1-bis-(2-hydroxy-3,5-dimethylphenyl)-3,5,5-trimethylhexane, 1,1-bis(2-hydroxy-3,5-di-t-butylphenyl)-2-methylpropane, 2,2-bis-(4-hydroxy-3-methylphenyl)propane, 4,4-bis-(4-hydroxy-3-methylphenyl)heptane, 2,2-bis-(4-hydroxy-3-isopropylphenyl)propane, 2,2-bis-(4-hydroxy-3-phenylphenyl)-propane, 1,1-bis-(4-hydroxy-3-methylphenyl)cyclohexane, 2,2-bis-(4-hydroxy-3,5-dimethylphenyl)-propane, 2,2-bis-(4-hydroxy-3-t-butyl-5-methylphenyl)propane, 3,3-bis-(4-hydroxy-3-t-dodecylphenyl)hexane, (4,4'-dihydroxy-3-methyldiphenyl)-2,2-propane, (4,4'-dihydroxy-3-t-octyldiphenyl)-2,2-propane, (4,4'-dihydroxy-3-t-butyldiphenyl)-4-methyl-2,2-pentane, (4,4'-dihydroxy-3-methyl-3'-t-butyldiphenyl)-2,2-propane, (4,4'-dihydroxy-3-methyl-5-t-butyldiphenyl)-2,2-propane, 2,2-bis-(4-hydroxyphenyl)propane, (4,4'-dihydroxy-3,3',5-trimethyldiphenyl)-3,3-pentane, N-(4-hydroxyphenyl)salicylamide-2,2-bis-(3,5-dibromo-4-hydroxyphenyl)propane, bis(3-methyl-4-hydroxy-5-t-butylphenyl)sulfide, etc.

9. ASCORBIC ACID AND ITS DERIVATIVES

*l*-Ascorbic acid, esters such as ethyl *l*-ascorbate, diesters such as diethyl *l*-ascorbate, etc.,

10. PYRAZOLIDONES

1-Phenyl-3-pyrazolidone, 4-methyl-4-hydroxymethyl-1-phenyl-3-pyrazolidone, etc.

These reducing agents can be used individually or as a combination of two or more. A suitable reducing agent is selected largely depending on the reducibility of the silver salt oxidizing agent component (a) used. For example, a strong reducing agent such as ascorbic acid is suitable for a silver salt which is very difficult to reduce, such as silver benzotriazole. For a silver salt of a higher fatty acid, it is necessary to select a stronger reducing agent as the number of carbons in the fatty acid increases. A relatively weak reducing agent such as p-phenylphenol is suitable for silver laurate, but a relatively strong reducing agent such as 1,1-bis-(2-hydroxy-3-t-butyl-5-methylphenyl)methane is preferably combined with silver behenate.

The effective amount of the reducing agent as described above depends generally on the oxidation-reduction combination of the components (a) and (c) and thus cannot be set forth unequivocally, but is preferably about 0.1 to 5 mols per mol of the silver salt oxidizing agent component (a).

Component (b) of the invention, that is, the catalytic amount of the light-sensitive silver halide, can be silver chloride, silver bromide, silver bromoiodide, silver chlorobromoiodide, silver chlorobromide, silver chloroiodide and silver iodide and mixture thereof. These light-sensitive silver halides can be in the form of either coarse grains or fine grains, but very fine silver halide grains are particularly suitable. The light-sensitive silver halide can be prepared using any of the methods well known in the field of photography. For example, a single jet method, a twin jet method such as a Lipmann emulsion, an ammonia method, a thiocyanate or thioether-ripened emulsions such as described in U.S. Pat. Nos. 2,222,264, 3,320,069 and 3,271,157 can be employed.

The silver halide component (b) used in the present invention can be sensitized with one or more chemical sensitizers such as reducing agents, sulfur or selenium compounds, gold, platinum and palladium compounds. Suitable sensitizing methods are described in U.S. Pat. Nos. 2,623,499, 2,399,083, 3,297,447 and 3,297,446.

As described above, a catalytic amount of the light-sensitive silver halide component (b) can be previously prepared and used as one component of the light-sensitive layer of the invention, but it is more preferred that a halogen-containing compound is present as a component for forming the catalytic amount of the silver halide when the organic silver salt component (a) of the light-sensitive layer of the invention is formed, thereby forming the light-sensitive silver halide simultaneously with the formation of the organic silver salt component (a), or the halogen-containing compound is reacted with the organic silver salt component (a) to form the light-sensitive silver halide in a part of the organic silver salt. For example, a solution of a halogen-containing compound such as ammonium bromide can be added to a polymer dispersion of an organic silver salt such as silver laurate. It is apparent from the change of the X-ray diffraction patterns that a part of the silver laurate and ammonium bromide react to form a silver bromide.

Suitable halogen-containing compounds which can be used to form the light-sensitive silver halide by reaction with the organic silver salt include inorganic halogen compounds, for example, represented by the formula $$MX_n'$$

wherein M represents a hydrogen atom, an ammonium group or a metal atom; X' represents a halogen atom and n is 1 when M is a hydrogen atom or an ammonium group and n represents the valence of the metal atom when M is a metal atom. Examples of these compounds are hydrogen halides, ammonium halides and strontium, cadmium, zinc, tin, chromium, sodium, barium, iron, cesium, lanthanum, calcium, nickel, magnesium, potassium, aluminum, antimony, gold, cobalt, mercury, lead, beryllium, lithium, manganese, gallium, indium, rhodium, ruthenium, palladium, iridium, platinum, thallium and bismuth halides. Suitable halides are chlorides, bromides, iodides and mixtures thereof.

Other examples of halogen-containing compounds which also can be used are halogenated hydrocarbons, for example, iodoform, bromoform, carbon tetrachloride, 2-bromo-2-methylpropane and the like. N-halo compounds, for example, compounds represented by the formula.

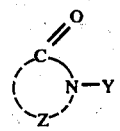

(IV)

or

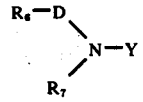

(V)

wherein Y represents a chlorine atom, a bromine atom or an iodine atom; Z represents the atoms necessary to complete a 5- to 7-membered ring which may be condensed with other rings; D represents a carbonyl group or a sulfonyl group; $R_6$ and $R_7$ each represents an alkyl group, an aryl group or an alkoxy group, for example, N-chlorosuccinimide, N-bromosuccinimide, N-bromophthalimide, N-bromoacetamide, N-iodosuccinimide, N-bromophthalazone, N-bromooxazolinone, etc., can be used. These compounds are disclosed in Japanese Pat. Application Nos. 126658/73 and 19760/74. In addition to the above compounds, benzotriazoles, for example, the N-halobenzotriazoles substituted with an alkyl group, a nitro group, a halogen atom, an imido group or an amino group; the N-halobenzimidazoles; other halogen-containing compounds, for example, triphenylmethyl chloride, triphenylmethyl bromide, 2-bromobutyric acid, 2-bromoethanol, dichlorobenzophenone can also be effectively used. Onium halides such as cetylethyldimethylammonium bromide can also be used.

The catalytic amount of the light-sensitive silver halide or the amount of the halogen-containing compound employed for forming the light-sensitive silver halide is generally about 0.001 to 0.5 mol per mol of an organic silver salt (a). If less than about 0.001 mol is used, the sensitivity is reduced, while, if more than about 0.5 mol is used, the quantity of the light-sensitive silver halide which tends to blacken gradually under normal room light is too large, resulting in a gradual blackening of the non-image area when a heat-developed material is allowed to stand under normal room light and a deterioration in the contrast between the non-image area and the image area.

Any binder can be employed for the heat-developable light-sensitive material composition according to the present invention. Suitable binder materials are ordinarily hydrophobic but can be hydrophilic. These binder materials, which are transparent or semitransparent include natural materials such as gelatin, gelatin derivatives and cellulose derivatives and synthetic polymeric materials such as polyvinyl compounds and acrylamide polymers. Suitable synthetic polymeric compounds which can be used include dispersed vinyl compounds of the latex type. Furthermore, preferred high molecular weight materials and resins are polyvinyl butyral, cellulose acetate butyrate, polymethylmethacrylate, polyvinylpyrrolidone, ethyl cellulose, polystyrene, polyvinyl chloride, chlorinated rubbers, polyisobutyrene, butadiene-styrene copolymers, vinyl chloride-vinyl acetate copolymers, vinyl acetate-vinyl chloride-maleic acid copolymers and polyvinyl alcohol. The amount of such a binder is about 10:1 to 1:5, preferably 4:1 to 1:4, by weight to the organic silver salt (a).

When the light-sensitive material of the invention is heat developed, a heat fog inhibitor can be added in order to prevent heat fogging, i.e., blackening of the non-exposed area, from occurring. Suitable heat-fog inhibitors are mercury salts as described in U.S. Pat. No. 2,728,663; nitroindazoles; polyvalent metal salts such as calcium chloride as described in U.S. Pat. No. 2,839,405; palladium and platinum compounds as described in U.S. Pat. No. 2,566,263; N-halo compounds as described in Japanese Pat. Application Nos. 52266/1972 (German OLS 2,326,865), 8194/1973 (German OLS 2,402,161) and 2842/1973 (German OLS 2,364,630), for example, N-halosuccinimides such as N-bromosuccinimide and N-haloacetamides such as N-bromoacetamide. These compounds can be used individually or in combination.

All materials well known in the art can be used as a support for the heat-developable light-sensitive material of the invention. Typical examples of supports are cellulose nitrate films, cellulose ester films, poly(vinylacetal) films, polystyrene films, poly(ethyleneterephthalate) films, polycarbonate films, other synthetic resin materials, glass sheets, paper and metal sheets. Preferably paper supports have a clay or styrene-butadiene rubber incorporated in the paper.

An antistatic layer or a conductive layer can be provided on the heat-developable light-sensitive material of the invention. Moreover, an antihalation material or antihalation dye can be incorporated therein. If desired, an overcoated polymer layer can be provided on the light-sensitive layer in order to increase the transparency of the heat-developable light-sensitive layer, to increase the image density, to improve the raw storage property (i.e., retain on storage the properties the material has immediately after production) and, optionally, to increase the heat resistance of the film. The thickness of this overcoated polymer layer is preferably about 1 to 20 microns. If the overcoated polymer layer is thinner than about 1 micron, the above described effects cannot be obtained and, if the overcoated polymer layer is thicker than about 20 microns, the cost is increased without any particular additional advantages being achieved. Suitable polymers for the overcoated polymer layer are preferably heat resistant, colorless and solvent-soluble. Examples of suitable polymers are polyvinyl chloride, polyvinyl acetate, vinyl chloride-vinyl acetate copolymer, preferably, having a vinyl chloride content of about 50 mol% or more, polyvinyl butyral, polystyrene, polymethylmethacrylate, benzyl cellulose, ethyl cellulose, cellulose acetate butyrate, cellulose diacetate, cellulose triacetate, polyvinylidene chloride, chlorinated polypropylene, polyvinylpyrrolidone, cellulose propionate, polyvinyl formal, cellulose acetate phthalate, polycarbonate and cellulose acetate propionate. Moreover, gelatin, gelatin derivatives such as phthalated gelatin, acrylamide polymers, polyisobutylene, butadiene-styrene copolymers having a suitable monomeric ratio and polyvinyl alcohol can be used. Polymers having a heat resistance of about 115° F or higher and a refractive index of about 1.45 or more preferred. As the occasion demands, kaolin, starch, titanium dioxide, zinc oxide and silica can be incorporated in the overcoated polymer layer of the heat-developable photographic material of the invention. These matting agents can also be incorporated in the light-sensitive layer. Fluorescent brightening agents such as the stilbenes, triazines, oxazoles or coumarins can also be incorporated.

The heat-devlopable light-sensitive layer used in the invention and the overcoated layer thereon can be coated using various methods, for example, a dipping method, an air knife method, a curtain coating method and an extrusion coating method using a hopper as described in U.S. Pat. No. 2,681,294. If desired, two or more layers, for example, can simultaneously be coated.

In addition to the foregoing various materials, a suitable quantity of a photographic spectrally sensitizing dye can be added to change the light-sensitive spectral region of the light-sensitive material. Ordinarily, a light-sensitive material using a light-sensitive silver halide as a photocatalyst is sensitive to light ranging from the near ultraviolet to blue regions of the spectrum, but by adding a spectrally sensitizing dye the sensitivity can be expanded to longer wavelength lights. Examples of suitable spectrally sensitizing dyes are cyanine and merocyanine dyes having a structure in which condensed rings of a heterocyclic type or a benzenoid type are connected through an single methine chain, xanthene dyes including rhodamines and eosines, acridine dyes including methylene blue and thionine and styryl dyes. These dyes are described in Japanese Pat. Application Nos. 56332/1972 (German OLS 2,328,868), 127999/1972 (German OLS 2,363,586), 14916/1973 (German OLS 2,405,713), 7624/1973 (German OLS 2,401,982), 12587/1973 (German OLS 2,404,591) and 50903/1973, and U.S. Pat. Nos. 3,719,495 and 3,761,279. These sensitizing dyes can be added in the form of a solution or dispersion in an organic solvent so as to achieve the desired object. The amount of the sensitizing dye employed is preferably about $10^{-6}$ to $10^{-2}$ mol per mol or the organic silver salt component (a).

The above heat-developable light-sensitive material can be imagewise exposed using an ordinary light source such as a photographic flash, a xenon lamp, a tungsten lamp, a mercury lamp or a fluorescent lamp for copying and developed simply by heating. The developing temperature is preferably about 90° to 180° C, particularly 100° to 170° C. The developing time depends on the heating temperature employed and generally, 1 to 60 seconds is sufficient for obtaining a good image. Developing times outside this range can be employed also by appropriately increasing or decreasing the developing temperature.

Various means can be used for heating for development, for example, by contacting the above described light-sensitive material with a heated plate or with a heated drum or as occasion demands, by passing the light-sensitive material through a heated space. In some cases, heating with high frequency waves or a laser can be employed.

The following examples are given in order to illustrate the invention in greater detail. All parts, percents, ratios and the like are by weight unless otherwise indicated.

EXAMPLE 1

3.4 g of behenic acid was dissolved in 100 ml of toluene at 60° C and the solution was maintained at this temperture. With agitation by means of a stirrer, 100 ml of an aqueous solution of nitric acid (pH = 2.0, 25° C) was added thereto. The resulting mixed solution was held at 60° C, stirred with a stirrer and then mixed with 100 ml of an aqueous solution prepared by adding aqueous ammonia to about 80 ml of an aqueous solution containing 1.7 g of silver nitrate to form a silver ammonium complex salt and adding water to a total volume of 100 ml, thus obtaining a dispersion containing fine crystals of silver behenate. When this dispersion was allowed to stand at room temperature for 20 minutes, a separation of an aqueous phase and a toluene phase occurred. Then the aqueous phase was removed and 400 ml of fresh water was added to the toluene phase, followed by decantation. This procedure was repeated three times. Thereafter, 400 ml of toluene was added and the mixture was subjected to centrifugal separation, thus obtaining 4 g of silver behenate of spindle shaped crystals having a length of about 1 micron and width of about 0.05 micron.

2.5 g of the silver behenate was added to 20 ml of an isopropyl alcohol solution containing 2 g of polyvinyl butyral and the mixture was ball milled for 1 hour to prepare a polymer dispersion. To 20 ml of the polymer dispersion of the silver salt were added the following components to prepare a heat-developable light-sensitive composition and the composition was coated onto a polyethylene terephthalate film support in a silver coverage of 1.5 g per 1 $m^2$ of the support, thus obtaining a heat-developable Light-Sensitive Material (A).

| | |
|---|---|
| Ammonium Bromide (2.5% methanol solution) | 1 ml |
| Benzoxazolylidene Rhodanine (0.025% chloroform solution) | 1 ml |
| 2,2'-Methylene-bis(6-t-butyl-4-methylphenol) (25% 2-methoxyethanol solution) | 3 ml |
| Compound 1 (0.56% aqueous solution) | 2 ml |
| 2,4-Dihydroxybenzophenone (25% 2-methoxyethanol solution) | 3 ml |

For comparison, another heat-developable Light-Sensitive Material (B) not containing Compound 1 was prepared.

Onto the light-sensitive layers of Light-Sensitive Materials (A) and (B) was overcoated a 15% tetrahydrofuran solution of a vinyl chloride-vinyl acetate copolymer (comprising 95% by weight vinyl chloride and 5% by weight vinyl acetate) in a thickness of 10 microns on dry basis.

After each of the thus prepared Light-Sensitive Materials (A) and (B) was exposed to radiation from a tungsten lamp in an exposure quantity of 250,000 lux. sec and developed at 120° C for 10 seconds, the blackening transmission density was measured. (As the standard point of the density measurement in the examples, the film support was taken as the standard when a film support was used. The standard for the density measurement of the support was the density of the support which did not have any heat-developable photosensitive compositions coated thereon.)

A black color tone image having a transmission density of 2.0 was obtained in the case of Light-Sensitive Material (A), while a thin brown image having a transmission density of 0.4 was obtained in the case of the Light-Sensitive Material (B).

EXAMPLE 2

The procedure of Example 1 was repeated except that Compound 49 was used as a color toning agent in place of Compound 1. A black color tone image having a transmission density of 1.8 was obtained.

EXAMPLE 3

The procedure of Example 1 was repeated except that Compound 10 was used as a color toning agent in place of Compound 1. A black color tone image having a transmission density of 2.0 was obtained.

EXAMPLE 4

0.95 g of sodium hydroxide was dissolved in 100 ml of water and 5.0 g of lauric acid was dissolved therein by heating. After cooling the solution to room temperature, a solution of 1 g of lauric acid in 50 ml of toluene was added thereto and, with agitation by means of a stirrer at room temperature, 50 ml of an aqueous solution of 4.4 g of silver nitrate and a solution of 0.075 g of ammonium bromide dissolved in 25 ml of water were added at the same time. Thus a phase separation of an oily silver laurate phase (containing silver bromide as the silver halide catalyst of the invention) and aqueous phase containing water-soluble ions occurred, and the aqueous phase was removed by decantation. 5 g of the resulting silver laurate and 3.0 g of polyvinyl butyral were added to 20 ml of isopropyl alcohol and the mixture ball milled to prepare a polymer dispersion of the silver salt. To this polymer dispersion of the silver salt were added the following components to prepare a heat-developable light-sensitive coating composition and the composition was coated onto a paper support in a silver coverage of 0.5 g per 1 $m^2$ of the support, thus obtaining a heat-developable Light-Sensitive Material (A).

| | |
|---|---|
| Tetrachlorotetrabromofluorescein (sensitizing dye) (0.00025% methanol solution) | 5 ml |
| Compound 67 (1.6% dimethyl sulfoxide solution) | 1 ml |
| p-Phenylphenol (reducing agent) (20% acetone solution) | 4 ml |

For comparison, another heat-developable Light-Sensitive Material (B) was prepared in a similar manner except Compound 67 was not employed.

These two Light-Sensitive Materials (A) and (B) were exposed to radiation from a tungsten lamp using a stepwise wedge in an exposure quantity of 250,000 lux. sec and developed by heating at 120° C for 30 seconds.

In the case of Light-Sensitive Material (A) containing the color toning agent of the invention, a black color tone image having a maximum density of 1.4 was obtained, while in the case of Light-Sensitive Material (B), a thin brown image having a maximum density of only 0.4 was obtained.

EXAMPLES 5 to 12

When the following compounds were used in place of Compound 67 in a similar manner to Example 4, black color tone images were easily obtained.

| Example | Compound No. |
|---|---|
| 5 | 4 |
| 6 | 9 |
| 7 | 15 |
| 8 | 23 |
| 9 | 27 |
| 10 | 28 |
| 11 | 34 |
| 12 | 57 |

EXAMPLE 13

1.9 g of sodium hydroxide was dissolved in 200 ml of water. A solution of 1.2 g of lauric acid in 100 ml of toluene was added thereto and emulsified by stirring using a stirrer. After stirring at 800 rpm for 5 minutes, a solution of 8.5 g of silver nitrate in 50 ml of water was added over a 60 second period to prepare silver laurate. The thus precipitated silver laurate was removed, mixed with 30 g of polyvinyl butyral and 200 ml of isopropyl alcohol and then the mixture ball milled to prepare a polymer dispersion of the silver salt. To 50 g of this dispersion was added 6 ml of a 1.4% methanol solution of N-bromosuccinimide and the dispersion was stirred at 50° C for 90 minutes. To 25 g of the thus prepared silver salt dispersion were added the following components to prepare a heat-developable light-sensitive material composition and the composition was coated onto a paper support (coated paper) in a silver coverage or 0.4 g per 1 $m^2$ of the support, thus producing heat-developable Light-Sensitive Material (A).

| | |
|---|---|
| 2',7'-Dichlorofluorescein (sensitizng dye) (0.00025% methanol solution) | 3 ml |
| Compound 8, 6-methyl-2,4-dihydroxy-pyrimidine (1.5% dimethyl sulfoxide solution) | 1 ml |
| 2,2-bis-(4-Hydroxy-3,5-dimethylphenyl)-propane (reducing agent, 20% acetone solution) | 5 ml |

For comparison, another heat-developable Light-Sensitive Material (B) not containing Compound 8 was prepared.

These two Light-Sensitive Materials (A) and (B) were subjected to exposure to radiation from a tungsten lamp using a stepwise wedge in an exposure quantity of 250,000 lux. sec and then developed by heating at 120° C for 30 seconds.

In the case of Light-Sensitive Material (A) containing the color toning agent of the invention, a black color tone image having a maximum density of 1.5 was obtained, while in the case of Light-Sensitive Material (B), a thin brown color tone image having a maximum density of only 0.3 was obtained.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support having thereon one or more layers containing a. an organic silver salt oxidizing agent;

b. a catalytic amount of about 0.001 to about 0.5 mole per mole of (a) of a light-sensitive silver halide or a compound capable of forming a light-sensitive silver halide through reaction with the organic silver salt component (a);

c. a reducing agent; and d. at least one compound represented by the following general formulae (I) to (III)

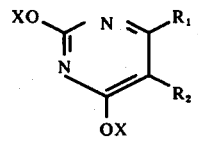
(I)

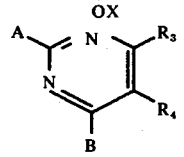
(II)

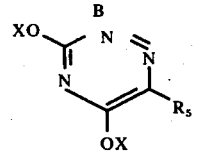
(III)

in which A and B each represents different substituents selected from the group consisting of an amino group and a —OX group; X is selected from the group consisting of a hydrogen atom, an alkali metal atom, a silver atom, a mercury atom and a gold atom; $R_1$ and $R_2$ each is selected from the group consisting of an alkyl group, an alkoxy group, an aralkyl group, an allyl group, an acyl group, an aryl group, an aryloxy group, each having up to 21 carbon atoms, a hydrogen atom and a halogen atom; and $R_3$, $R_4$ and $R_5$ each is selected from the group consisting of a hydrogen atom, a halogen atom and an alkyl group having up to 21 carbon atoms, said compound represented by the general formulae (I) to (III) being present in an amount of about $1 \times 10^{-3}$ to about 5 moles per mole of the silver salt oxidizing agent (a); and wherein said components (a) to (d) may be present in the same layer or may be distributed individually or in combination in more than one layer.

2. The heat-developable light-sensitive material of claim 1, wherein said alkali metal atom of X is selected from the group consisting of a lithium atom, a sodium atom, a potassium atom and a rubidium atom, wherein said halogen atom for $R_1$, $R_2$, $R_3$, $R_4$ and $R_5$ is selected from the group consisting of a chlorine atom, a bromine atom and an iodine atom, wherein said alkyl group for $R_1$, $R_2$, $R_3$, $R_4$ and $R_5$ is an alkyl group having from 1 to 4 carbon atoms, said alkoxy group for $R_1$ and $R_2$ is an alkoxy group having 1 to 4 carbon atoms, wherein said aryl group for $R_1$ and $R_2$ is selected from the group consisting of a phenyl group and a 1-naphthyl group, wherein said aralkyl group for $R_1$ and $R_2$ is selected from the group consisting of a benzyl group and a phenethyl group, and wherein said acyl group for $R_1$ and $R_2$ is an acyl group having from 1 to 4 carbon atoms.

3. The heat-developable light-sensitive material of claim 1, wherein said alkyl group for $R_1$, $R_2$, $R_3$, $R_4$ and $R_5$ is selected from the group consisting of an unsubstituted alkyl group having 1 to 4 carbon atoms and a substituted alkyl group having 1 to 4 carbon atoms in the alkyl moiety and containing 1 or more of substituents selected from the group consisting of a halogen atom, a hydroxyl group, an amino group, a monoalkylamino group and a diazkylamino group.

4. The heat-developable light-sensitive material of claim 1, wherein said at least one compound (d) is selected from the group consisting of 2,4-dihydroxypyrimidine, 2-hydroxy-4-aminopyrimidine and azauracil.

5. The heat-developable light-sensitive material of claim 1, wherein said organic silver salt oxidizing agent (a) is a silver salt of an organic compound containing a moiety selected from the group consisting of a carboxy group, an imino group and a mercapto group.

6. The heat-developable light-sensitive material of claim 1, wherein said reducing agent (c) is selected from the group consisting of a monohydroxybenzene, a dihydroxybiphenyl, a dihydroxy-benzene, a polyhydroxy-benzene, a naphthol, a naphthylamine, an aminonaphthol, a hydroxybinaphthyl, an aminophenol, a p-phenylenediamine, an alkylene bisphenol, ascorbic acid, an ascorbic acid derivative and a pyrazolidone.

7. The heat-developable light-sensitive material of claim 1, wherein said light-sensitive silver halide (b) is selected from the group consisting of silver chloride, silver bromide, silver bromoidodide, silver chlorobromoiodide, silver chloroiodide, silver iodide and mixtures thereof.

8. The heat-developable light-sensitive material of claim 1, wherein said compound capable of forming a light-sensitive silver halide through reaction with the organic silver salt component (a) is a compound represented by the formula $$MX'_n$$

wherein M represents a hydrogen atom, an ammonium group, or a metal atom; X' represents a halogen atom; n is 1 when M is a hydrogen atom or an ammonium atom and n represents the valence of the metal atom when M is a metal atom; an organic halogen containing compound selected from the group consisting of triphenylmethyl chloride, triphenylmethyl bromide, 2-bromobutyric acid, 2-bromoethanol, and dichlorobenzophenone; a halogenated hydrocarbon selected from the group consisting of iodoform, bromoform, carbon tetrachloride, and 2-bromo-2-methylpropane; an onium halide; a N-halo compound represented by the formula

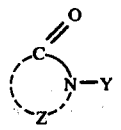

(IV)

or

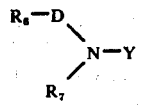

(V)

wherein Y represents a chlorine atom, a bromine atom or an iodine atom; Z represents the atoms necessary to complete a 5- to 7-membered ring which may be considered with other rings; D represents a carbonyl group or a sulfonyl group; $R_6$ and $R_7$ each is selected from the group consisting of an alkyl group, an aryl group and an alkoxy group; an N-halobenzimidazole; or an N-halobenzotriazole.

9. The heat-developable light-sensitive material of claim 1, wherein said reducing agent (c) is present in an amount of about 0.1 to about 5 moles per mole of said organic silver salt oxidizing agent (a).

* * * * *